US005649518A

United States Patent [19]

Maki et al.

[11] Patent Number: 5,649,518

[45] Date of Patent: Jul. 22, 1997

[54] FUEL METERING CONTROL SYSTEM FOR INTERNAL COMBUSTION ENGINE

[75] Inventors: Hidetaka Maki; Yusuke Hasegawa; Yoichi Nishimura, all of Wako, Japan

[73] Assignee: Honda Giken Kogyo Kabushiki Kaisha, Tokyo, Japan

[21] Appl. No.: 514,859

[22] Filed: Aug. 14, 1995

[30] Foreign Application Priority Data

Feb. 25, 1995 [JP] Japan ..... 7-061661

[51] Int. Cl.[6] ..... F02D 41/14

[52] U.S. Cl. ..... 123/682; 123/694; 123/696

[58] Field of Search ..... 123/674, 675, 123/682, 694, 696; 364/431.05

[56] References Cited

U.S. PATENT DOCUMENTS

| | | | |
|---|---|---|---|
| 4,392,471 | 7/1983 | Miyagi et al. | 123/687 X |
| 4,744,345 | 5/1988 | Yamato | 123/680 |
| 5,558,076 | 9/1996 | Maki et al. | 123/694 X |

FOREIGN PATENT DOCUMENTS

| | | |
|---|---|---|
| 2-275043 | 11/1990 | Japan . |
| 4-209940 | 7/1992 | Japan . |

OTHER PUBLICATIONS

Computrol (Corona Publishing Co., Ltd.) No. 27, pp. 28–41.

Automatic Control Handbook (Ohm Publishing Co., Ltd.).

"A Survey of Model Reference Adaptive Techniques—Theory and Applications" by I.D. Landau, *Automatica*, vol. 10, pp. 353–379, 1974.

"Unification of Discrete Time Explicit Model Reference Adaptive Control Designs" by I.D. Landau et al, *Automatica*, vol. 17, No. 4, pp. 593–611, 1981.

"Combining Model Reference Adaptive Controllers and Stochastic Self-tuning Regulators'" by I.D. Landau, *Automatica*, vol. 18, No. 1, pp. 77–84, 1982.

*Primary Examiner*—Tony M. Argenbright

*Attorney, Agent, or Firm*—Nikaido Marmelstein Murray & Oram LLP

[57] ABSTRACT

A fuel metering control system for an internal combustion engine, having a feedback loop. In the system, the quantity of fuel injection (Tim) to be supplied to the engine (plant) is determined outside of the feedback loop. A feedback correction coefficient (KSTR) is calculated using an adaptive controller and a feedback control is carried out by multiplying the quantity of fuel injection by the coefficient in the feedback control region. In view of the situation, once leaving the feedback control region due to, for example, fuel cutoff, but soon returning to the feedback control region shortly, internal variables of the adaptive controller necessary for coefficient calculation are held so as to make it unnecessary to determine the variables and to keep the control continuity and to enhance the controllability. On the other hand, if it takes a longer time to return the region, the variables are set to initial values.

29 Claims, 8 Drawing Sheets

FUEL METERING CONTROL SYSTEM FOR INTERNAL COMBUSTION ENGINE

BACKGROUND OF THE INVENTION

1. Field of the Invention

This invention relates to a fuel metering control system for an internal combustion engine.

2. Description of the Prior Art

The PID control law is ordinarily used for fuel metering control for internal combustion engines. The control error between the desired value and the manipulated variable (control input) is multiplied by a P term (proportional term), an I term (integral term) and a D term (differential or derivative term) to obtain the feedback correction coefficient (feedback gain). In addition, it has recently been proposed to obtain the feedback correction coefficient by use of modern control theory or the like, as taught in Japanese Laid-Open Patent Application No. Hei 4(1992)-209,940.

Aside from the above, such a situation is frequently encountered. Namely, shortly after the acceleration pedal has once been released, fuel cutoff effected and open-loop control implemented, it often happens that the accelerator pedal is soon depressed again, causing the engine to accelerate and feedback control to be resumed. The feedback control is resumed after only a short time in this way, making it necessary to calculate the feedback correction coefficient once again.

When calculating the feedback correction coefficient using a control law such as an adaptive control law, the feedback correction coefficient, thus calculated, has high control response. However, it will take time for a controlled variable to become stable unless the correction coefficient upon returning to the feedback control is determined appropriately.

An object of the invention is therefore to provide a fuel metering control system for an internal combustion engine which determines the feedback correction coefficient appropriately at the time of returning from an open-loop control to feedback control such that the controlled variable becomes stable immediately.

SUMMARY OF THE INVENTION

This invention achieves these objects by providing a system for controlling fuel metering for an internal combustion engine, comprising air/fuel ratio detecting means for detecting an air/fuel ratio (KACT) of an exhaust gas of the engine, engine operating condition detecting means for detecting an operating condition of the engine, fuel injection quantity determining means for determining a quantity of fuel injection (Tim) to be supplied to the engine, feedback correction coefficient calculation means for calculating a feedback correction coefficient (KSTR) using an adaptive controller, feedback control region discriminating means for discriminating at to whether or not the detected engine operating condition is in a feedback control region where a feedback control is to be carried out, and feedback control means for correcting a manipulated variable by the feedback correction coefficient (KSTR) to bring at least one of the detected air/fuel ratio (KACT) and the quantity of fuel injection (Ti) to a desired value (KCMD) in the feedback control region. In the system it is arranged such that said feedback correction coefficient calculation means holds a value necessary for calculating the feedback correction coefficient (KSTR), when leaving the feedback control region.

BRIEF EXPLANATION OF THE DRAWINGS

These and other objects and advantages of the invention will be more apparent from the following description and drawings, in which.

DETAILED DESCRIPTION OF THE PREFERRED EMBODIMENTS

Embodiments of the invention will now be explained with reference to the drawings.

Figure 1:
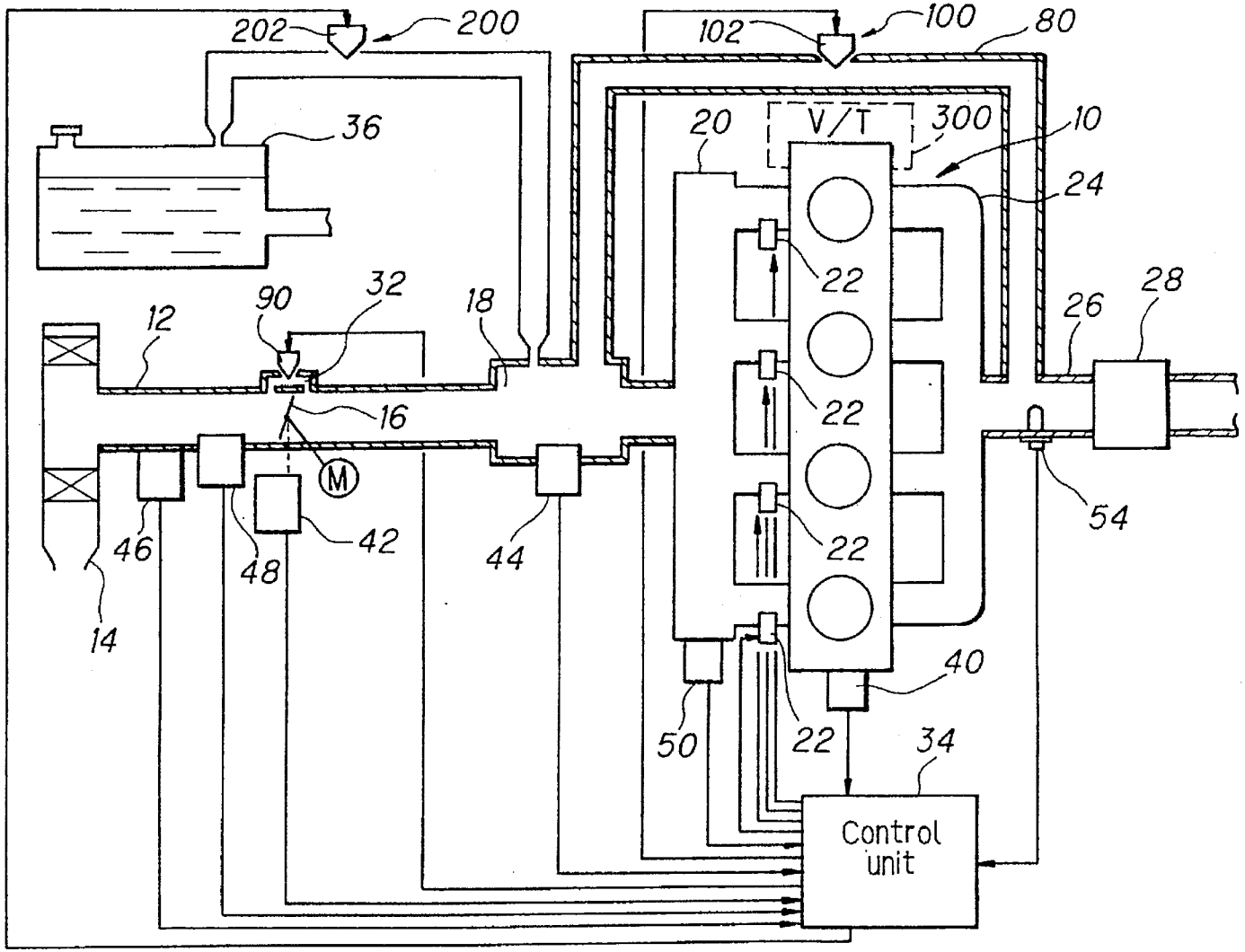
FIG. 1 is an overall block diagram showing a fuel metering control system according to the invention.

FIG. 1 is an overview of a fuel metering control system for an internal combustion engine according to the invention.

Reference numeral 10 in this figure designates an OHC in-line four-cylinder internal combustion engine. Air drawn in an air intake pipe 12 through an air cleaner 14 mounted on a far end thereof is supplied, while being adjusted by a throttle valve 16, to the first to fourth cylinders through a surge tank 18, an intake manifold 20 and two intake valves (not shown). A fuel injector 22 for injecting fuel is installed in the vicinity of the intake valves of each cylinder. The injected fuel mixes with the intake air to form an air-fuel mixture that is ignited in the associated cylinder by a spark plug (not shown). The resulting combustion of the air-fuel mixture drives down a piston (not shown).

The exhaust gas produced by the combustion is discharged through two exhaust valves (not shown) into an exhaust manifold 24, from where it passes through an exhaust pipe 26 to a catalytic converter (three-way catalyst) 28 where noxious components are removed therefrom before being discharged to the atmosphere. Not mechanically linked with the accelerator pedal (not shown), the throttle valve 16 is controlled to the desired degree of opening by a stepping motor M. In addition, the throttle valve 16 is bypassed by a bypass 32 provided in the vicinity thereof.

The engine 10 is equipped with an exhaust gas recirculation mechanism 100 and with a canister purge mechanism 200 connected between the air intake system and a fuel tank 36. Since these mechanisms are unrelated to the principle of the invention, however, they will not be explained in detail.

Figure 2:
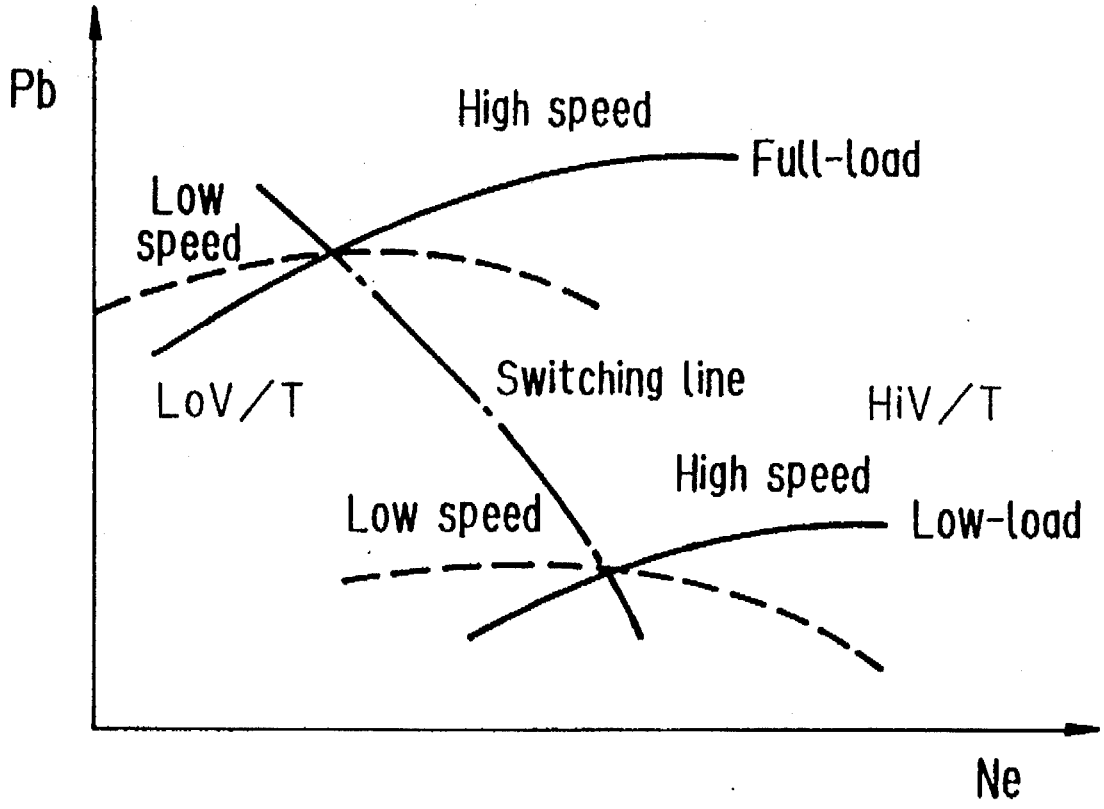
FIG. 2 is a graph showing the valve timing switching characteristics of a variable valve timing mechanism provided with the engine shown in FIG. 1.

The engine 10 is also equipped with a variable valve timing mechanism 300 (denoted as V/T in FIG. 1). As taught by Japanese Laid-open Patent Application No. Hei 2(1990)-275,043, for example, the variable valve timing mechanism 300 switches the opening/closing timing of the intake and/or exhaust valves between two types of timing characteristics, i.e, the characteristic for low engine speed named LoV/T and that for high engine speed named HiV/T as illustrated in FIG. 2 in response to engine speed Ne and manifold pressure Pb. Since this is a well-known mechanism, however, it will not be described further here. (Among the different ways of switching between valve timing characteristics is included that of deactivating one of the two intake valves.)

A crank angle sensor 40 for detecting the piston crank angles is provided in the distributor (not shown) of the internal combustion engine 10, a throttle position sensor 42 is provided for detecting the degree of opening of the throttle valve 16, and a manifold absolute pressure sensor 44 is provided for detecting the pressure of the intake manifold downstream of the throttle valve 16 in terms of the absolute value.

An atmospheric pressure sensor 46 for detecting atmospheric pressure is provided at an appropriate portion of the engine 10, an intake air temperature sensor 48 for detecting the temperature of the intake air is provided upstream of the throttle valve 16, and a coolant temperature sensor 50 for detecting the temperature of the engine coolant is provided at an appropriate portion of the engine. The engine 10 is further provided with a valve timing (V/T) sensor 52 (not shown in FIG. 1) which detects the valve timing characteristic selected by the variable valve timing mechanism 300 based on oil pressure.

Further, an air/fuel ratio sensor 54 constituted as an oxygen detector or oxygen sensor, is provided at the exhaust pipe 26 at, or downstream of, a confluence point in the exhaust system between the exhaust manifold 24 and the catalytic converter 28, where it detects the oxygen concentration in the exhaust gas at the confluence point and produces a signal (later explained). The outputs of all the sensors are sent to a control unit 34.

Figure 3:
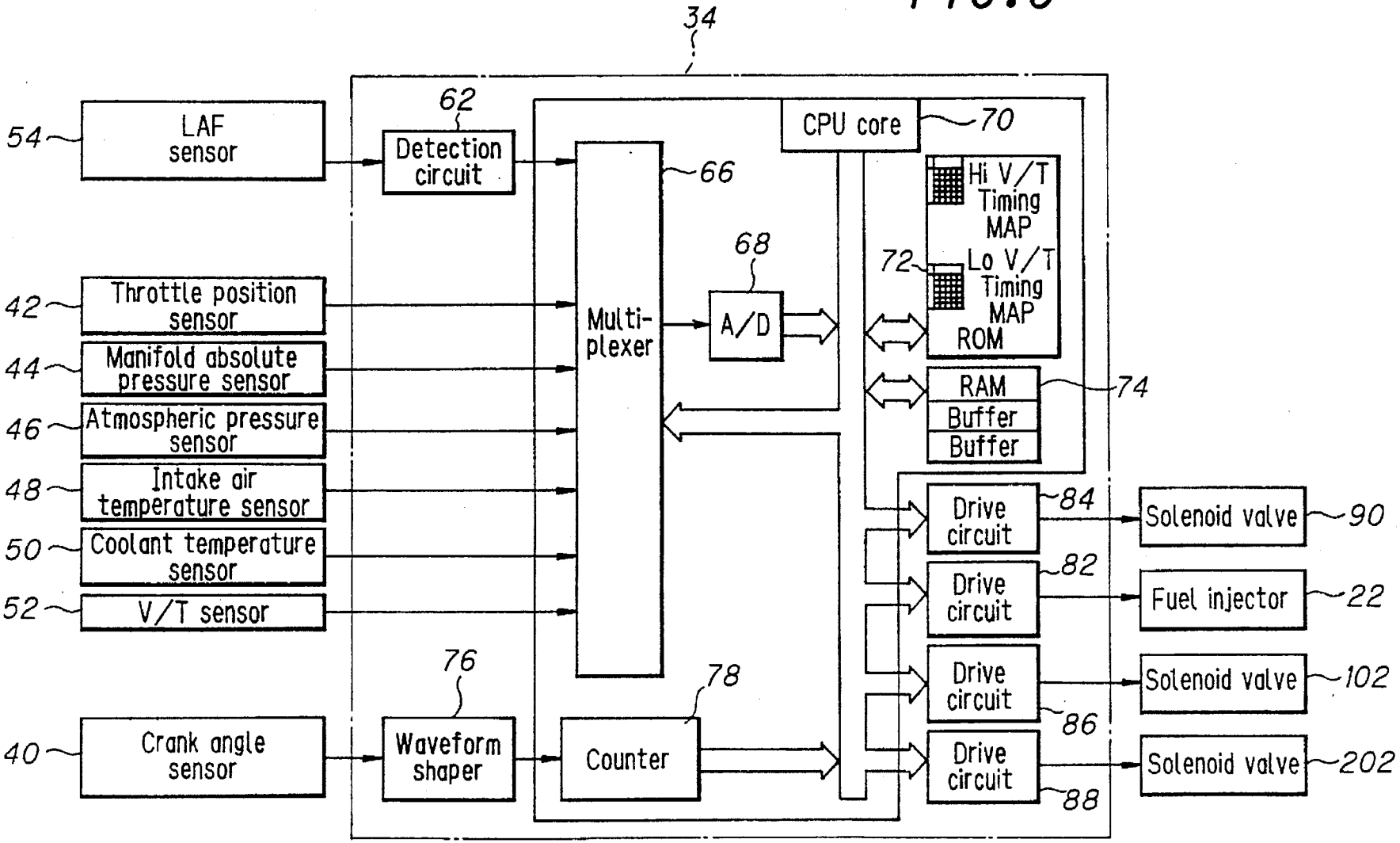
FIG. 3 is a block diagram showing the details of the control unit illustrated in FIG. 1.

Details of the control unit 34 are shown in the block diagram of FIG. 3. The output of the air/fuel ratio sensor 54 is received by a detection circuit 62, where it is subjected to appropriate linearization processing for producing an output characterized in that it varies linearly with the oxygen concentration of the exhaust gas over a broad range extending from the lean side to the rich side. (The air/fuel ratio sensor will be referred to as "LAF sensor" in the figure and the remainder of this specification.)

The output of the detection circuit 62 is forwarded through a multiplexer 66 and an A/D converter 68 to a CPU (central processing unit). The CPU has a CPU core 70, a ROM (read-only memory) 72 and a RAM (random access memory) 74 and the output of the detection circuit 62 is A/D-converted once every prescribed crank angle (e.g., 15 degrees) and sequentially stored in buffers of the RAM 74. Similarly, the analog outputs of the throttle position sensor 42, etc., are input to the CPU through the multiplexer 66 and the A/D converter 68 and stored in the RAM 74.

The output of the crank angle sensor 40 is shaped by a waveform shaper 76 and has its output value counted by a counter 78. The result of the count is input to the CPU. In accordance with commands stored in the ROM 72, the CPU core 70 computes a manipulated variable in the manner described later and drives the fuel injectors 22 of the respective cylinders via a drive circuit 82. Operating via drive circuits 84, 86 and 88, the CPU core 70 also energizes/deenergizes a solenoid valve (EACV) 90 (for opening and closing the bypass 32 to regulate the amount of secondary air), a solenoid valve 102 for controlling the amount of recirculated exhaust gas, and a solenoid valve 202 for controlling the amount of canister purge.

Figure 4:
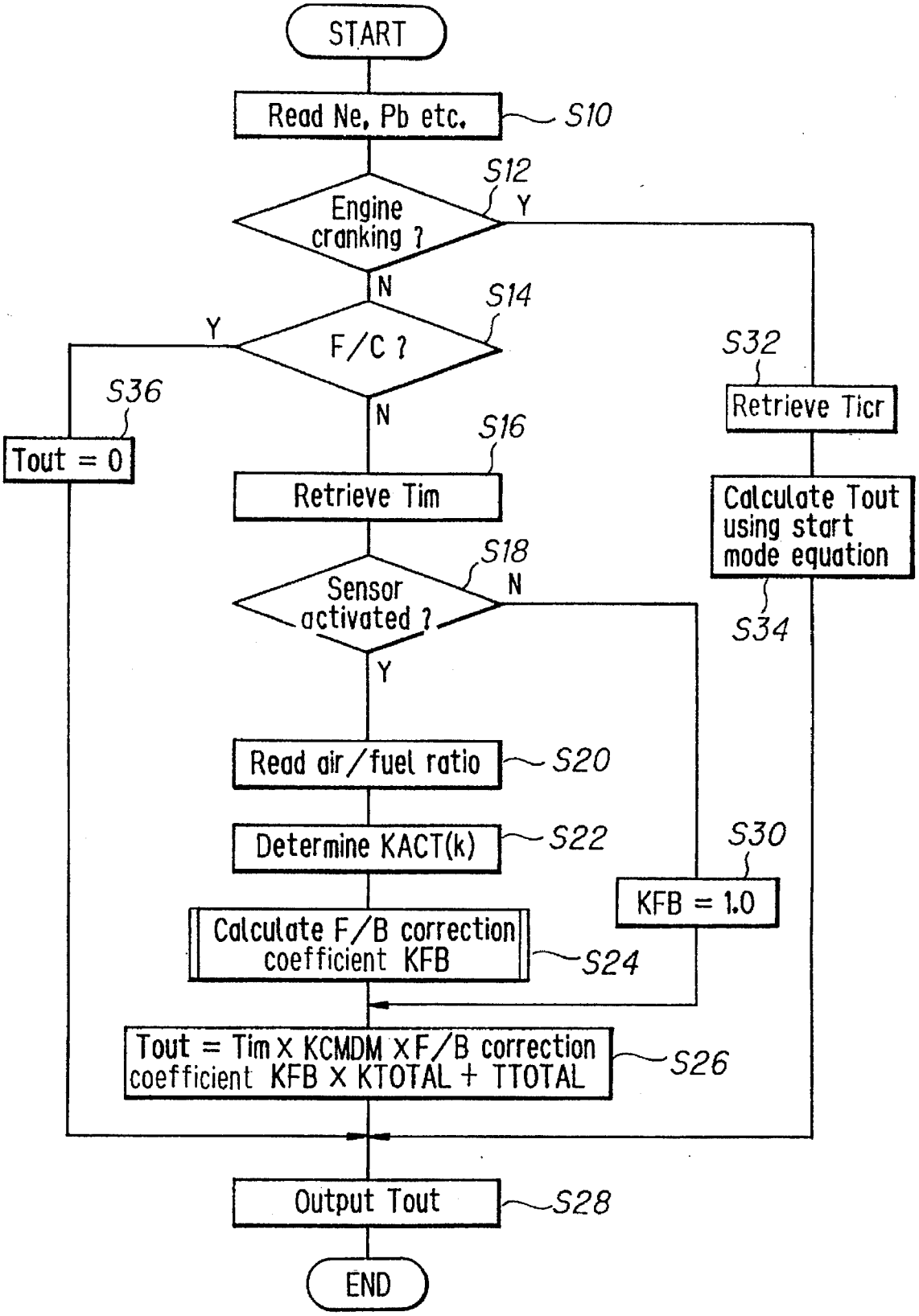
FIG. 4 is a flowchart showing the operation of the fuel metering control system according to the invention.

FIG. 4 is a flowchart showing the operation of the system. The routine of FIG. 4 is activated once every prescribed crank angle.

Figure 5:
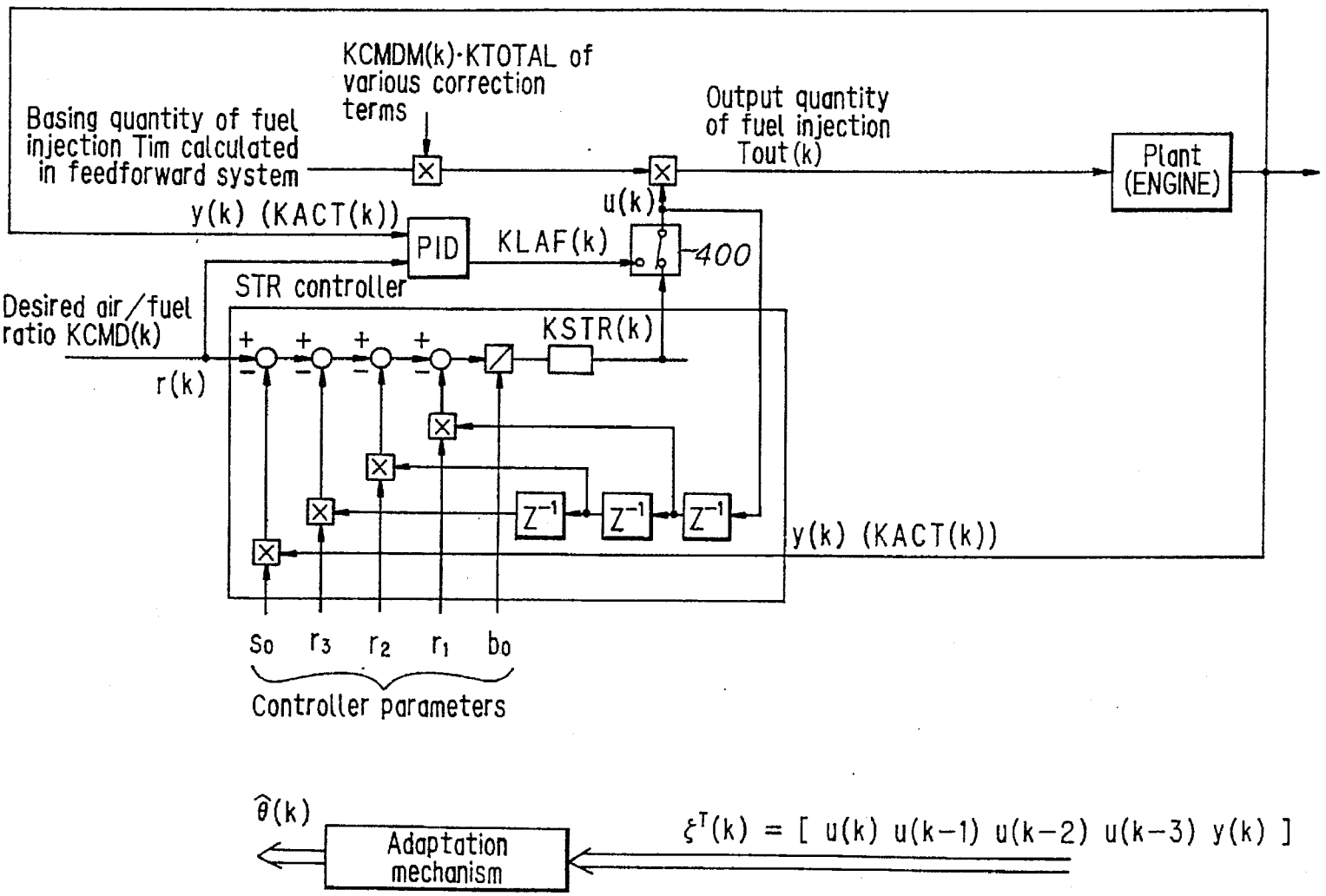
FIG. 5 is a block diagram similarly showing the operation of the system more functionally.

FIG. 5 is a block diagram illustrating the operation of the system more functionally. First explaining the system with reference to FIG. 5, the system is provided with a first calculation means constituted as an adaptive controller (STR type adaptive controller; indicated as an "STR controller" in the figure) which uses the adaptive control law based on a recursion formula to calculate a first feedback correction coefficient (indicated as "KSTR(k)" in the figure) so as to bring the detected air/fuel ratio (indicated as "KACT(k)") to a desired air/fuel ratio (indicated as "KCMD(k)") using the quantity of fuel injection as the manipulated variable (k: the sample number in discrete-time system).

In addition, the system is provided with a second calculation means constituted as a PID controller (indicated as "PID" in the figure) which uses a second type of control law, specifically, which uses the PID control law, to calculate a second feedback correction coefficient (indicated as "KLAF (k)"), that is inferior in control response (lesser in control response) than the first feedback correction coefficient, so as to cause the detected air/fuel ratio KACT to equal the desired value KCMD similarly using the quantity of fuel injection as the manipulated variable. The output of the first calculation means or the second calculation means is selected based on the engine operating condition detected in the manner described latter, and the basic quantity of fuel injection Tim (calculated in a feed-forward system in accordance with an empirically determined characteristic and stored as mapped data retrievable by engine speed and manifold pressure) is multiplied by the selected coefficient to obtain the output quantity of fuel injection Tout.

Based on the above, the operation of the system will be explained with reference to FIG. 4.

In FIG. 4, the program starts at S10 in which the detected engine speed Ne and manifold pressure Pb, etc., are read, and proceeds to S12 in which a check is made as to whether or not the engine is cranking, and if it is not, to S14 in which a check is made as to whether the supply of fuel has been cut off. Fuel cutoff is implemented under specific engine operating conditions, such as when the throttle is fully closed and the engine speed is higher than a prescribed value, at which time the supply of fuel is stopped and open-loop control is effected.

If it is found in S14 that fuel cutoff is not implemented, the program proceeds to S16 in which the basic quantity of fuel injection Tim is calculated by retrieval from the aforesaid map using the detected engine speed Ne and manifold pressure Pb as address data. Next, the program proceeds to S18 in which it is checked whether activation of the LAF sensor 54 is complete. This is done by comparing the difference between the output voltage and the center voltage of the LAF sensor 54 with a prescribed value (0.4 V, for example) and determining that activation is complete when the difference is smaller than the prescribed value.

If S18 finds that activation is complete, the program goes to S20 in which the output of the LAF sensor is read, to S22 in which the air/fuel ratio KACT(k) is determined or calculated from the output, and to S24 in which the feedback correction coefficient KFB (the general name for KSTR and KLAF) is calculated. As mentioned earlier, k is used to mean a discrete variable in this specification and the sample number in the discrete-time system.

Figure 6:
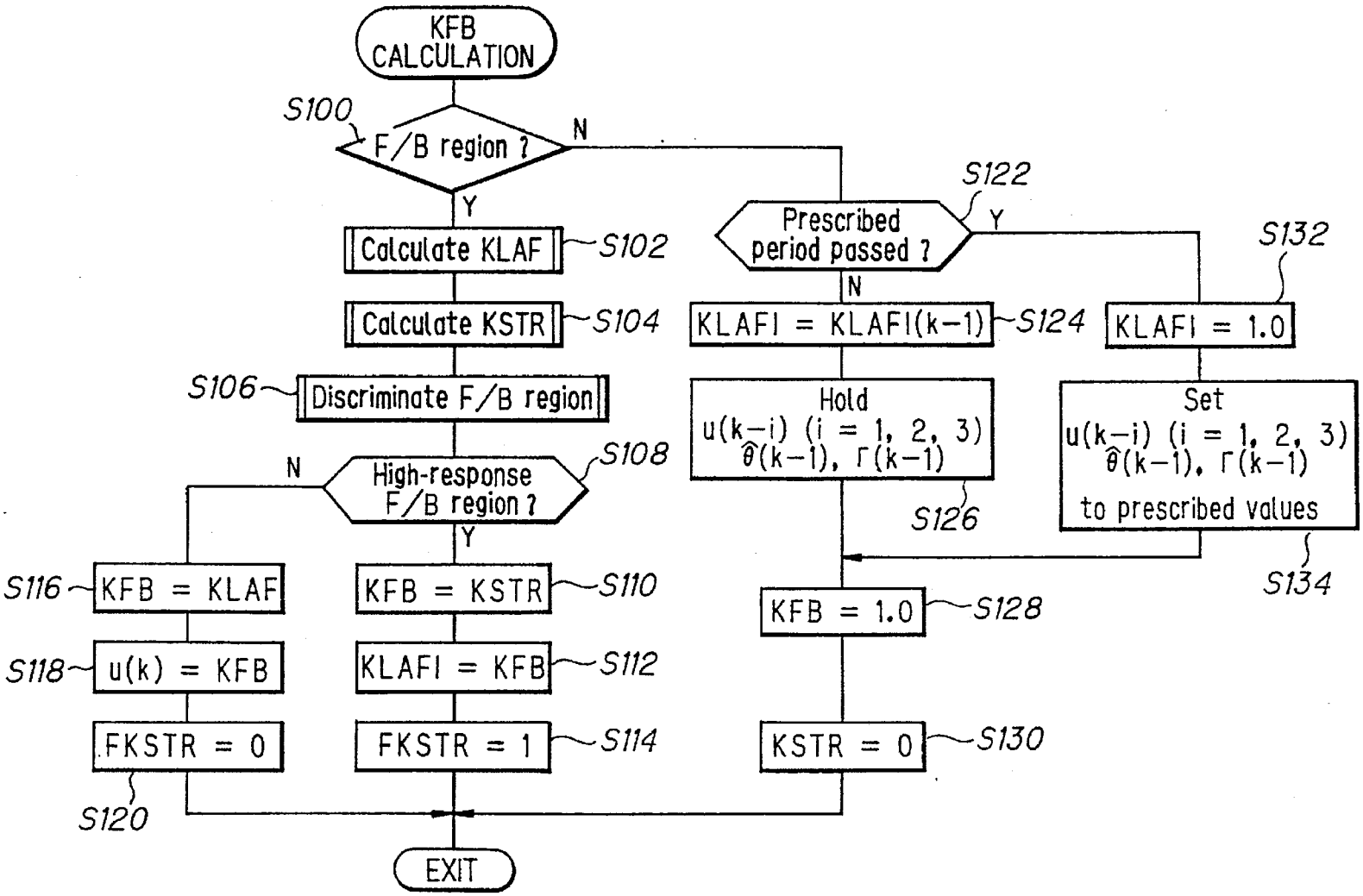
FIG. 6 is a subroutine flowchart of FIG. 4 showing the calculation of a feedback correction coefficient KFB.

The subroutine for this calculation is shown by the flowchart of FIG. 6.

The program begins at S100 in which a discrimination is made as to whether or not the engine operating condition is in a feedback control region. This is conducted using a separate subroutine not shown in the drawings. Open loop control is implemented, for example, when the engine operating condition has changed suddenly, such as during full-load enrichment, high engine speed, or when the exhaust gas recirculation mechanism is operating.

If the result in S100 is YES, the program proceeds to S102 in which the feedback correction coefficient KLAF is calculated using the PID control law. This will hereinafter be referred to as the "PID correction coefficient" or "KLAF". The feedback correction coefficient KLAF determined by the PID control law is calculated as follows. First, the control error DKAF between the desired air/fuel ratio KCMD and the detected air/fuel ratio KACT is calculated as $$DKAF(k)=KCMD(k-d')-KACT(k).$$

In this equation, KCMD(k–d') is the desired air/fuel ratio (in which d' indicates the dead time before KCMD is reflected in KACT and thus signifies the desired air/fuel ratio before the dead time control cycle), and KACT(k) is the detected air/fuel ratio (in the current control (program) cycle). In this embodiment, however, the desired value KCMD and the detected value KACT are represented as the equivalence ratio so as to facilitate the calculation, namely, as Mst/M=1/lambda (Mst: stoichiometric air/fuel ratio, M=A/F (A: air mass flow rate, F: fuel mass flow rate), and lambda=excess air factor).

Next, the control error DKAF(k) is multiplied by specific coefficients to obtain variables, i.e., the P (proportional) term KLAFP(k), I (integral) term KLAFI(k), and D (differential or derivative) term KLAFD(k) as:

P term: $KLAFP(k)=DKAF(k)\times KP$

I term: $KLAFI(k)=KLAFI(k-1)+DKAF(k)\times KI$

D term: $KLAFD(k)=(DKAF(k)-DKAF(k-1))\times KD.$

Thus, the P term is calculated by multiplying the error by the proportional gain KP, the I term is calculated by adding the value of KLAFI(k–1), the feedback correction coefficient in the preceding control cycle (k–1), to the product of the error and the integral gain KI, and the D term is calculated by multiplying the difference between the value of DKAF(k), the error in the current control cycle (k), and the value of DKAF(k–1), the error in the preceding control cycle (k–1), by the differential gain KD. The gains KP, KI and KD are calculated based on the engine speed and the engine load. Specifically, they are retrieved from a map using the engine speed Ne and the manifold pressure Pb as address data. Finally, KLAF(k), the value of the feedback correction coefficient calculated by the PID control law in the current control cycle, is calculated by summing the thus-obtained values:

$$KLAF(k)=KLAFP(k)+KLAFI(k)+KLAFD(k).$$

In this case, the offset of 1.0 is assumed to be included in I term KLAFI(k) so that the feedback correction coefficient is a multiplication coefficient (namely, the I term KLAFI(k) is given an initial value of 1.0).

The program then moves to S104 of the subroutine of FIG. 6, in which the feedback correction coefficient KSTR is calculated using the adaptive control law. This will hereinafter be referred to as the "adaptive correction coefficient" or "KSTR."

This calculation will now be explained. The adaptive controller shown in FIG. 5 comprises an adaptive controller constituted as an STR controller and an adaptation mechanism (system parameter estimator) for estimating/identifying the system parameters. The desired value KCMD(k) and the controlled variable y(k) (plant output) of the fuel metering control feedback system are input to the STR controller, which receives a coefficient vector estimated/identified by the adaptation mechanism and generates the control input u(k).

One identification algorithm available for the adaptive control is that proposed by I. D. Landau et al. This method is described in, for example, *Computrol* (Corona Publishing Co., Ltd.) No. 27, pp. 28–41; *Automatic Control Handbook* (Ohm Publishing Co., Ltd.) pp. 703–707, "A Survey of Model Reference Adaptive Techniques—Theory and Applications" by I. D. Landau in *Automatica,* Vol. 10, pp. 353–379; "Unification of Discrete Time Explicit Model Reference Adaptive Control Designs" by I. D. Landau et al in Automatica, Vol. 17, No. 4, pp. 593–611; and "Combining Model Reference Adaptive Controllers and Stochastic Self-tuning Regulators" by I. D. Landau in *Automatica,* Vol. 18, No. 1, pp. 77–84.

The identification algorithm proposed by I. D. Landau et al. is used in the illustrated adaptive controller. In the identification algorithm proposed by I. D. Landau, if the polynomials of the denominator and numerator of the transfer function $A(Z^{-1})/B(Z^{-1})$ of the discrete controlled system are defined in the manner of Eq. 1-1 and Eq. 1-2 shown below, then the controller parameters or system (adaptive) parameters $\hat{\theta}(k)$ which are made up of parameters as shown in Eq. 1-3 and are expressed as a vector (transpose matrix). And the input zeta (k) to the adaptation mechanism becomes that shown by Eq. 1-4 (transpose matrix). Here, there is taken as an example a plant in which m=1, n=1 and d=3, namely, the plant model is given in the form of linear system with three control cycles of dead time:

$$A(z^{-1}) = 1 + a_1 z^{-1} + \ldots + a_n z^{-n} \quad \text{Eq. 1-1}$$

$$B(z^{-1}) = b_0 + b_1 z^{-1} + \ldots + b_m z^{-m} \quad \text{Eq. 1-2}$$

$$\begin{aligned}\hat{\theta}^T(k) &= [\hat{b}_0(k), \hat{B}_R(z^{-1}, k), \hat{S}(z^{-1}, k)] \quad \text{Eq. 1-3}\\ &= [\hat{b}_0(k), \hat{r}_1(k), \ldots, r_{m+d-1}(k), s_0(k), \ldots, s_{n-1}(k)]\\ &= [b_0(k), r_1(k), r_2(k), r_3(k), s_0(k)]\end{aligned}$$

$$\begin{aligned}\zeta^T(k) &= [u(k), \ldots, u(k-m-d+1), y(k), \ldots, y(k-n+1)] \quad \text{Eq. 1-4}\\ &= [u(k), u(k-1), u(k-2), u(k-3), y(k)]\end{aligned}$$

The controller parameter vector (controller parameters) $\hat{\theta}(k)$ is calculated by Eq. 2. In Eq. 2, $\Gamma(k)$ is a gain matrix (the (m+n+d)th order square matrix) that determines the estimation/identification speed of the controller parameter $\hat{\theta}$ and e asterisk is a signal indicating the generalized estimation/identification error. They are represented by recursion formulas such as those of Eqs. 3 and 4:

$$\hat{\theta}(k) = \hat{\theta}(k-1) + \Gamma(k-1)\zeta(k-d)e^*(k) \quad \text{Eq. 2}$$

$$\Gamma(k) = \frac{1}{\lambda_1(k)}\left[\Gamma(k-1) - \frac{\lambda_2(k)\Gamma(k-1)\zeta(k-d)\zeta^T(k-d)\Gamma(k-1)}{\lambda_1(k)+\lambda_2(k)\zeta^T(k-d)\Gamma(k-1)\zeta(k-d)}\right] \quad \text{Eq. 3}$$

-continued $$e^*(k)=\frac{D(z^{-1})y(k)-\hat{\theta}^T(k-1)\zeta(k-d)}{1+\zeta^T(k-d)\Gamma(k-1)\zeta(k-d)} \quad \text{Eq. 4}$$

Various specific algorithms are given depending on the selection of $lambda_1$, $lambda_2$ in Eq. 3. lambda 1(k)=1, lambda 2(k)=lambda (0<lambda<2) gives the gradually-decreasing gain algorithm (least square method when lambda=1) and lambda 1(k)=lambda 1 (0<lambda 1<1), lambda 2(k)=lambda 2 (0<lambda 2<lambda) gives the variable-gain algorithm (weighted least square method when lambda 2=1). Further, defining lambda 1(k)/lambda 2(k)=σ and representing lambda 3 as in Eq. 5, the constant-trace algorithm is obtained by defining lambda 1(k)=lambda 3(k). Moreover, lambda 1(k)=1, lambda 2(k)=0 gives the constant-gain algorithm. As is clear from Eq. 3, in this case Γ(k)=Γ(k−1), resulting in the constant value Γ(k)=Γ.

$$\lambda_3(k)=1-\frac{\|\Gamma(k-1)\zeta(k-d)\|^2}{\sigma+\zeta^T(k-d)\Gamma(k-1)\zeta(k-d)}\cdot\frac{1}{tr\Gamma(0)} \quad \text{Eq. 5}$$

In the diagram of FIG. 5, the STR controller (adaptive controller) and the adaptation mechanism (system parameter estimator) are placed outside the system for calculating the quantity of fuel injection and operate to calculate the feedback correction coefficient KSTR(k) so as to adaptively bring the detected value KACT(k) to the desired value KCMD(k−d') (where d' is the dead time before KCMD is reflected in KACT as mentioned repeatedly). In other words, the STR controller receives the coefficient vector $\hat{\theta}(k)$ adaptively estimated/identified by the adaptation mechanism and forms a feedback compensator so as to bring it to the desired value KCMD(k−d'). The basic quantity of fuel injection Tim is multiplied by other correction terms KCMDM(k), KTOTAL (both explained later) and the calculated feedback correction coefficient KSTR(k) and the corrected quantity of fuel injection is supplied to the controlled plant (internal combustion engine) as the output quantity of fuel injection Tout(k).

Thus the adaptive feedback correction coefficient KSTR (k) and the detected value KACT(k) are determined and input to the adaptation mechanism, which calculates the controller parameter vector $\hat{\theta}(k)$ and are input to the STR controller. The desired value KCMD(k) is applied as input to the STR controller. Based on these variables, the STR controller uses a recursion formula to calculate the feedback correction coefficient KSTR(k) so as to bring the detected value KACT(k)to the desired value KCMD(k). The feedback correction coefficient KSTR(k) is specifically calculated as shown by Eq. 6:

$$KSTR(k)=\frac{KCMD(k-d')-s_0xy(k)-r_1xKSTR(k-1)-r_2xKSTR(k-2)-r_3xKSTR(k-3)}{b_0} \quad \text{Eq. 6}$$

As explained in the foregoing, the detected value KACT (k) and the desired value KCMD(k) are also input to the PID controller (illustrated as PID in the figure), which calculates the PID correction coefficient KLAF(k) based on the PID control law explained in connection with S102 so as to eliminate the control error between the detected value at the exhaust system confluence point and the desired value. One or the other of the feedback correction coefficient KSTR, obtained by the adaptive control law, and the PID correction coefficient KLAF, obtained using the PID control law, is selected to be used in determining the fuel injection calculation quantity by a switching mechanism 400 shown in FIG. 5.

Calculations are carried out in parallel in the STR controller and the PID controller. Specifically, the adaptation mechanism indicated by Eqs. 2 to 4 is input with intermediate variables zeta (k−d), namely, with vectors lumping together the current and past control values u(k)(KSTR(k)) and y(k)(KACT(k)), and calculates the system parameters $\hat{\theta}(k)$ from the cause and effect relationship therebetween. u(k) used here is the aforesaid feedback correction coefficient used in the fuel injection quantity calculation. Under a condition where PID control is to be conducted instead of adaptive control in the next control cycle, the PID correction coefficient KLAF is used as the feedback correction coefficient. While conducting PID control, even if the input u(k) to the adaptation mechanism is changed from the adaptive correction coefficient KSTR(k) to KLAF(k), since the plant output (controlled variable) generated in accordance with the feedback correction coefficient and used for fuel metering control, namely KACT(k+d'), is output and since the cause-effect relationship is therefore established between the input and output, the adaptation mechanism can calculate the controller parameter vector $\hat{\theta}(k)$ without divergence. Thus, when $\hat{\theta}(k)$ is input to Eq. 6, KSTR(k) is calculated. At this time, the replacement KSTR(k−i)=KLAF(k−i) is permissible in the calculation of KSTR(k) (i=1, 2, 3).

Thus, the adaptive correction coefficient KSTR can be calculated even when the PID controller is operating and it has been confirmed that the PID correction coefficient KLAF and the adaptive correction coefficient KSTR are substantially identical at any particular time. Since the values of the PID correction coefficient KLAF and the adaptive correction coefficient KSTR are close, moreover, the switch between them is smooth.

Returning to the explanation of the FIG. 6 flowchart, the program moves to S106 in which the operating region is discriminated as to whether it is one in which the feedback control is to be conducted using the high-control-response feedback correction coefficient (adaptive correction coefficient KSTR) or using the low-control-response feedback correction coefficient (PID correction coefficient KLAF).

Figure 7:
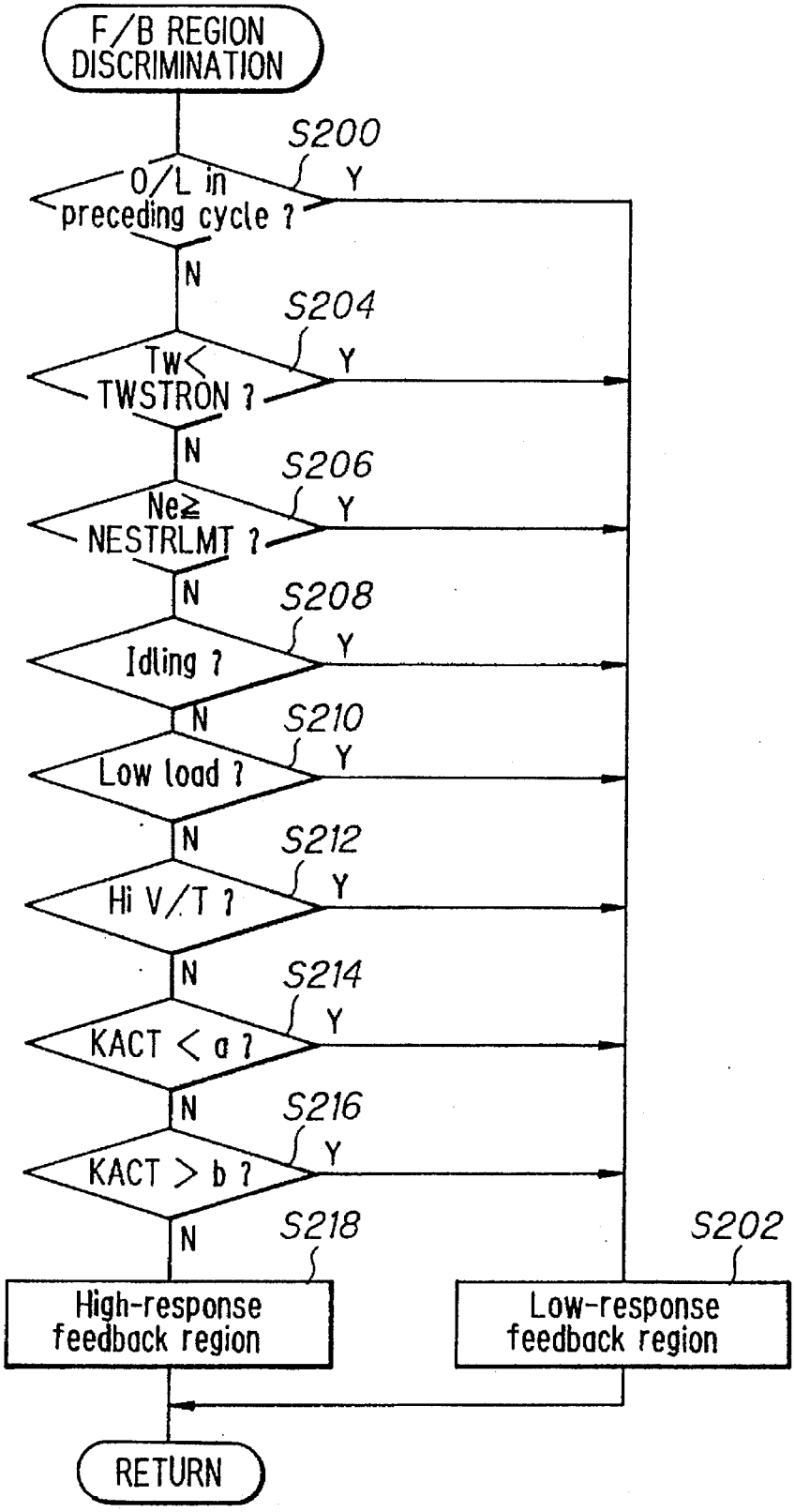
FIG. 7 is a subroutine flowchart of FIG. 6 showing the discrimination of a feedback control region; and, FIG. 8 is a timing chart showing the air/fuel ratio detection delay when fuel supply is resumed after fuel has been cut off.

FIG. 7 is the flowchart of a subroutine for this region discrimination.

First, in S200, it is checked whether open-loop control was in effect at the preceding control cycle, i.e., at the time the subroutine of FIG. 4 was activated in the preceding control cycle. If the result is YES, the program goes to S202 in which the region is determined to be one in which feedback control is to be conducted using the low-control-response feedback correction coefficient (PID correction coefficient KLAF) (hereinafter referred to as the "low-response feedback region"). This is because, for the reason explained earlier, it is preferable not to conduct high-response feedback control immediately after returning from open-loop control. In changing from open-loop control to feedback control it is possible to conduct low-response feedback control for a prescribed period (5 TDCs, for example (TDC: Top Dead Center). In such a case, it suffices to provide a discrimination step after S200 for continuously directing the program to S202 during the prescribed period.

If the result in S200 is NO, the program goes to S204 in which it is checked whether the engine coolant temperature Tw is less than a prescribed value TWSTRON. The prescribed value TWSTRON is set at a relatively low coolant temperature and if the detected engine coolant temperature TW is below the prescribed value TWSTRON, the program proceeds to S202 in which the engine operating condition is determined to be in the low-response feedback region. The reason for this is the combustion is unstable at low coolant temperatures, making it impossible to obtain a stable detection of the value KACT owing to misfiring and the like. Although not shown in FIG. 7, for the same reason, the operating conditions is also determined to be in the low-response feedback region when the coolant temperature is abnormally high.

If S204 finds that the engine coolant temperature TW is not lower than the prescribed value TWSTRON, the program advances to S206 in which it is checked whether the detected engine speed Ne is at or above a prescribed value NESTRLMT. The prescribed value NESTRLMT is set at a relatively high engine speed. If S206 finds that the detected engine speed Ne is at or above the prescribed value NESTRLMT, the program goes to S202 in which the operating condition is determined to be in the low-response feedback region. This is because during high-speed engine operation there tends to be insufficient time for calculation and, moreover, combustion is unstable.

If S206 finds that the detected engine speed Ne is lower than the prescribed value NESTRLMT, the program proceeds to S208 in which it is checked whether the engine is idling. If the result is YES, the program goes to S202 in which the operating condition is determined to be in the low-response feedback region. This is because the generally stable operating condition during idling obviates the need for a high gain such as that according to the adaptive control law.

If S208 finds that the engine is not idling, the program proceeds to S210 in which it is judged whether the engine load is low. If the result is YES, the program goes to S202 in which the operating condition is determined to be in the low-response feedback region. This is because combustion is not stable in the low engine load region.

If S210 finds that the engine load is not low, the program proceeds to S212 in which a check is made whether HiV/T (high-engine-speed side valve timing) is selected in the variable valve timing mechanism. If so, to S202 in which the operating condition is determined to be in the low-response feedback region. This is because a large amount of valve timing overlap present when the high-engine-speed side valve timing characteristic is selected is apt to cause intake air blowby (escape of intake air through the exhaust valve), in which case the detected value KACT is not likely to be stable. In addition, the detection delay of the LAF sensor cannot be ignored during high-speed operation.

The decision as to whether or not high-speed side valve timing is selected is made not only based on whether or not high-speed valve timing has actually been selected but also with reference to an appropriate flag indicating whether or not a command to switch the valve timing characteristics from the low-speed side to the high-speed side has been issued in a control unit (not shown) of the variable valve timing mechanism. This is because changes in valve timing characteristics may not be implemented at all cylinders simultaneously. During transient states and the like, therefore, cases may occur in which the valve timing characteristic temporarily differs between different cylinders. In other words, in switching the valve timing characteristic to the high-speed side, it is arranged so that the switch to the high-speed side is conducted in the control unit of the variable valve timing mechanism after confirmation that feedback control using the PID correction coefficient is in effect as a result of a discrimination that the engine operating condition is in the low-response feedback region.

If the result in S212 is NO, the program goes to S214 in which it is checked whether the detected air/fuel ratio KACT is below a prescribed value a. If the result is YES, the program goes to S202. If NO, it goes to S216 in which a check is made as to whether the detected value KACT is greater than a prescribed value b. If the result is YES, the program goes to S202. If NO, it goes to S218 in which the operating condition is determined to be in a region in which feedback control is to be conducted using a high-control-response feedback correction coefficient (feed back correction coefficient KSTR) (hereinafter referred to as the "high-response feedback region"). The prescribed values a and b are appropriately set for enabling discrimination of lean and rich air/fuel ratios since it is better to avoid high-response control such as adaptive control when the air/fuel ratio is lean or rich. In making the discrimination, the desired air/fuel ratio can be used in place of the detected air/fuel ratio for comparison with the prescribed values.

Returning to the subroutine of FIG. 6, it is then checked in S108 whether the region is determined to be the high-control-response feedback region. If the result is YES, the feedback correction coefficient KFB is set to or replaced with the feedback correction coefficient KSTR in S110, whereafter the I term KLAFI of the PID correction coefficient is set to or replaced with the feedback correction coefficient KFB in S112. The reason for this is that the I term (integral term) may change suddenly when the adaptive correction coefficient KSTR is switched to the PID correction coefficient KLAF in the next control cycle. By determining the initial value of the I term of the PID correction coefficient KLAF using the value of the adaptive correction coefficient KSTR in this way, the difference in level between the adaptive correction coefficient and the PID correction coefficient can be reduced to prevent sudden change in the controlled variable and ensure stable control. Next, in S114, the bit of a flag FKSTR is set to 1 to indicate that the quantity of fuel injection is corrected using the adaptive correction coefficient KSTR.

On the other hand, if S108 finds that the operating condition is not in the high-response region, the feedback correction coefficient KFB is set to the PID correction coefficient KLAF in S116 and the plant input u(k) is set to the feedback correction coefficient KFB in S118 (which will be input to the STR controller as shown in FIG. 5). This is because even outside the STR control region the STR controller continues to operate using the PID correction coefficient KLAF. The bit of the flag FKSTR is then reset to 0 in S120.

If S100 finds that the operating condition is not in the feedback region, the program goes to S122 in which a check is made as to whether or not a prescribed period, or time, has passed since leaving the feedback region. If the result is NO, the program goes to S124 where the value of KLAF in the current control cycle is set to or replaced with KLAFI(k−1), the value of the I term in the preceding control cycle, which is to say that the I term is held. Next, in S126, the internal or intermediate variables of the adaptive controller are similarly held at the preceding value, i.e., the final value during adaptive control.

The PID correction coefficient KLAF is calculated using the I term (integral term) when held. This is because, as mentioned earlier, a rapid change may occur in the I term when the feedback correction coefficient is calculated following a switchover from adaptive control to PID control at the next control cycle. By using the value of KSTR to determine the initial value of the I term of the PID correction coefficient in the foregoing manner, the difference between the adaptive correction coefficient and the PID correction coefficient is small. As a result, it becomes possible to prevent the controlled variable from changing suddenly, ensuring control stability.

Moreover, the reason for carrying out the procedure at S126 is, as shown in FIG. 5, the calculation of zeta(k) uses the plant input u, not only the control input u(k) at the current control cycle but also u(k–1) and other past values of preceding control cycles. Therefore, i of u(k–i) in S126 is a comprehensive symbol encompassing the current and past control values. The procedure at S126 thus means that u(k), u(k–1), u(k–2) and u(k–3), more precisely, u(k–1), u(k–2), u(k–3) and u(k–4) are held. The system parameters $\hat{\theta}$ and the gain matrix F are simply held at their preceding values. In a case such as when the controller parameters (controller parameter vector) $\hat{\theta}$ and the gain matrix $\Gamma$ are stored in memory as mapped values, the map value can be used in place of the held value. Further, though not shown in the drawings, KSTR and KACT are also held at the final values in adaptive control. KACT and input u(k–i) can of course be lumped together and held as zeta.

Next, in S128, the value of the feedback correction coefficient KFB is set to 1.0, which is to say that feedback control is not conducted. The bit of the flag FKSTR is then reset to 0 in S130.

On the other hand, if S122 finds that the prescribed period has passed since leaving the feedback region, the value of the I term KLAFI is set to 1.0 (initial value) in S132, whereafter the plant input u, the system parameters $\hat{\theta}$ and the gain matrix $\Gamma$ are set to prescribed values, e.g., their initial values in S134. The plant input u is specifically set to u(k)=u(k–1)=u(k–3)=1.

This is related to a frequently encountered situation. Namely, shortly after the accelerator pedal has once been released, fuel cutoff effected and open-loop control implemented, it often happens that the accelerator pedal is soon depressed again, causing the engine to accelerate and feedback control to be resumed. When feedback control is resumed after only a short time in this way, almost no change arises in the operating condition of the engine between before and after the non-operating region of the STR controller and, therefore, the cause-effect relationship with the combustion history naturally holds.

In the case of a transitory region of this kind, therefore, holding the internal variables of the adaptive controller improves the control stability by maintaining the continuity of the adaptive control and enabling the adaptive control to be conducted without unnecessarily returning to the initial state. In this sense, the prescribed period referred to regarding S122 defines a time range during which the cause-effect relationship with the combustion history continues to hold. The term "period" used here is defined to include both intervals measured in time and intervals measured in control (program) cycles (number of combustion cycles, TDCs etc.).

When the prescribed period or longer has passed, on the other hand, in can be assumed that a large change has occurred in the operating state of the engine between before and after the non-operating region of the STR controller. In this case, therefore, the I term of the PID correction coefficient is set to 1.0 in S132 and the internal variables are returned to prescribed values, for instance, their initial values, in S134. An initial value of $\hat{\theta}$(k–1) and u(k) (=KSTR (k)) can be stored in memory for each operating region of the internal combustion engine and the stored values be used as the past values of $\hat{\theta}$(k–1) and zeta (k–d). This further improves the controllability at resumption of adaptive control. In addition, $\hat{\theta}$(k) can be learned for each operating region.

Next, in S26 of the routine of FIG. 4, the basic quantity of fuel injection Tim is multiplied by a value KCMDM (explained later), the calculated feedback correction coefficient KFB and the correction coefficients KTOTAL, and the addition term TTOTAL is added to the result to obtain the corrected output quantity of fuel injection Tout in the manner described earlier. The output quantity fuel injection Tout is then output to the drive circuit 82 of the fuel injector 22 as the manipulated variable in S28.

Here, KCMDM is a correction coefficient and is determined based on the desired air/fuel ratio (more precisely the equivalence ratio) KCMD. Specifically, in order to correct the quantity of fuel injection by the desired air/fuel ratio through multiplication, the air/fuel ratio is determined as the equivalence ratio and is adjusted by the charging efficiency. More specifically, the charging efficiency of intake air varies as the evaporation heat varies. For that reason, the value KCMD is adjusted by this and is renamed as KCMDM. The other correction coefficients KTOTAL is the total value of the coefficients of the various corrections for coolant temperature, etc., conducted by multiplication terms and TTOTAL indicates the total value of the various corrections for atmospheric pressure, etc., conducted by addition terms (but does not include the injector dead time, etc., which is added separately at the time of outputting the output quantity of fuel injection Tout).

Since open-loop control of the air/fuel ratio goes into effect if the result is NO in S18, in this case the value of the feedback correction coefficient KFB is set to 1.0 in S30 and the output quantity of fuel injection Tout is calculated in S26. Since open-loop control is also implemented when S12 finds that the engine is cranking, in this case the output quantity of fuel injection Tout is calculated retrieving the quantity of fuel injection at cranking Ticr in S32 and based on a start mode equation using Ticr in S34. If S14 finds that fuel cutoff is effected, the output quantity of fuel injection Tout is set to 0 in S36.

In this embodiment, when open-loop control of the fuel metering and air/fuel ratio is discontinued and feedback control is resumed, as in the case of a transitory region of the kind such as shortly after the accelerator pedal has once been released, fuel cutoff being effected, the accelerator pedal has soon been depressed once again and the supply of fuel is resumed, and the internal variables of the adaptive controller are held, it becomes therefore possible to keep the continuity of adaptive control and carry out the adaptive control without causing it to return to its initial state unnecessarily.

On the other hand, when the prescribed period has passed since leaving the feedback control region, it can be assumed that a large change has occurred in the operating state of the engine, and it is configured so that the internal variables of the adaptive controller are returned to prescribed values, for instance, their initial values. With the arrangement, there is no likelihood that the feedback correction coefficient is calculated to be an inappropriate value. Moreover, since the internal variables are returned to the prescribed values, the calculation is facilitated. These further improve the controllability at resumption of adaptive control.

Figure 8:
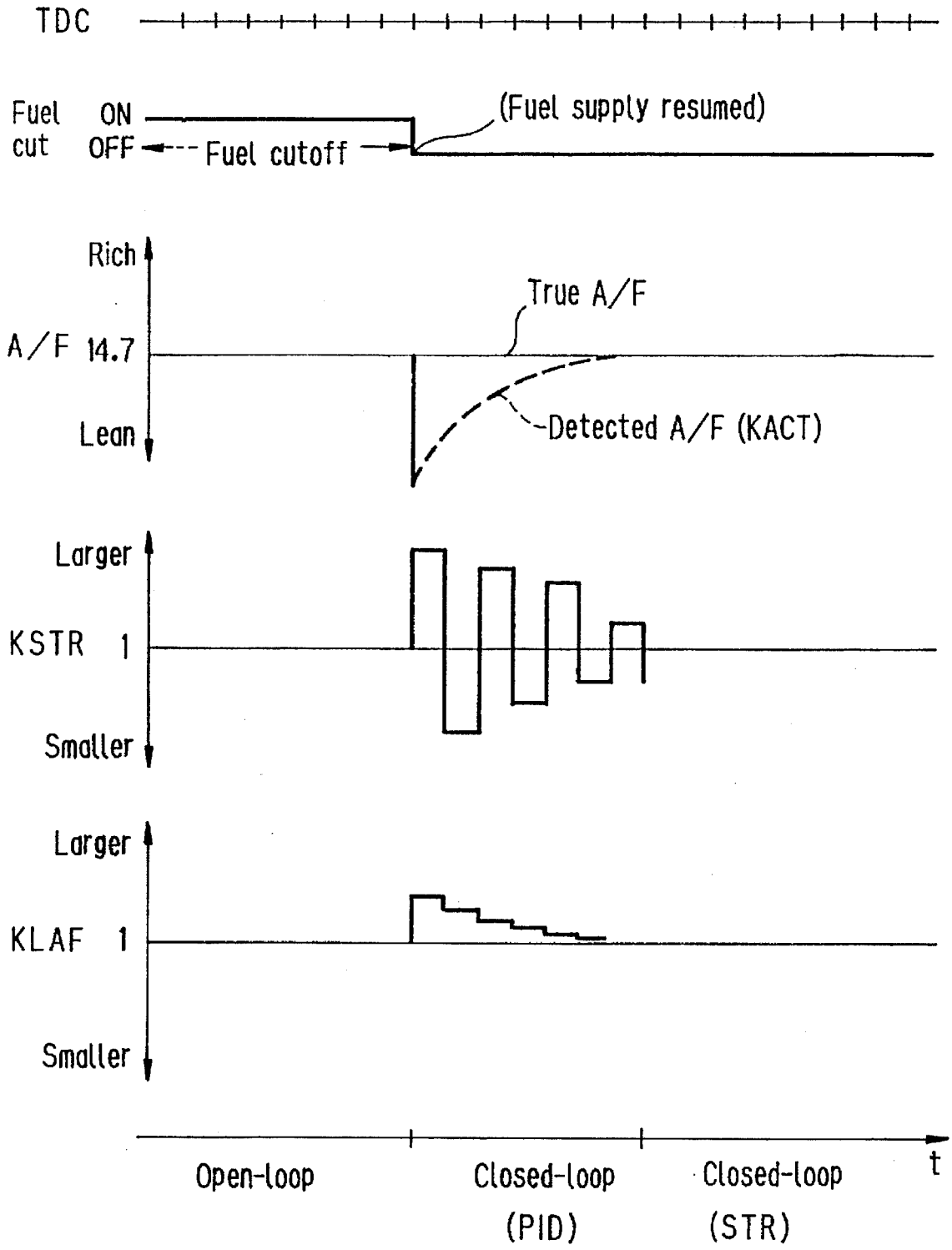

Furthermore, the arrangement is configured to have the two kinds of feedback correction coefficients, made of the high-control-response adaptive correction coefficient and the low-control-response PID correction coefficient, and the PID correction coefficient is continually used for a period since the termination of the open-loop control and the resumption of the feedback control such as at the time of returning from the fuel cutoff. As a result, the feedback correction coefficient of high control response determined by the adaptive control law is not used during periods when the difference between the true air/fuel ratio and the detected air/fuel ratio is large owing to the time required for the supplied fuel to be combusted and to the detection delay of the sensor itself. The controlled variable therefore does not become unstable and degrade the stability of the control, as is disclosed in FIG. 8.

On the other hand, the convergence speed can be improved after the detected value has stabilized by using the feedback correction coefficient of high control response determined by the adaptive control law for operating the system so as to absorb the control error all at one time. A particularly notable feature of the embodiment is that an optimal balance is achieved between control stability and control convergence owing to the fact that the control convergence is improved by determining the manipulated variable as the product of the feedback correction coefficient and the manipulated variable.

In addition, since the STR controller and the PID controller are operated in parallel while mutually replacing the internal variables so as to calculate the adaptive correction coefficient KSTR and the PID correction coefficient KLAF in parallel, the transition from the adaptive correction coefficient KSTR to the PID correction coefficient KLAF and vice versa can be smoothly conducted. Further, the fact that switching between the two types of correction coefficients can be conducted with a desired timing makes it possible to achieve optimum switching, while the fact that the switching can be conducted without producing spikes in the air/fuel ratio results in improved fuel metering and air/fuel ratio controllability.

Although the embodiment is configured to have the two kinds of feedback correction coefficients, different in control response, determined by the adaptive control law and the PID control law, and the quantity of fuel injection is corrected with either, the configuration is not limited thereto, and use of only adaptive correction coefficients, different in control response, will be possible.

It should also be noted that, although it is configured that the internal variables are returned to the prescribed values when a prescribed period has passed, and the initial values are taken as examples of the prescribed values, it is alternatively possible to return the internal variables to other values than the initial values.

While PID control is taken as an example in the embodiment, it is permissible instead to appropriately set the KP, KI and KD gains for conducting PI control and to control only the I term. In other words, the PID control referred to in the specification is established insofar as it includes some of the gain terms.

While the air/fuel ratio, more precisely the equivalence ratio, is used as the desired value in the embodiment, the quantity of fuel injection can instead be used as the desired value.

While the adaptive correction coefficients KSTR and KLAF are calculated as multiplication coefficients (terms) in the embodiment, they can instead be calculated as addition terms.

Moreover, while the embodiment is described with respect to examples using STR as the adaptive controller, MRACS (model reference adaptive control systems) can be used instead.

Furthermore, the invention is not limited to the arrangement and can instead be configured to have an air/fuel ratio sensor (LAF sensor) disposed in the exhaust system in a number equal to the number of cylinders and so as to detect the air/fuel ratios in the individual cylinders based on the outputs of the individual cylinders.

While the invention has thus been shown and described with reference to the specific embodiments, it should be noted that the invention is in no way limited to the details of the described arrangements, changes and modifications may be made without departing from the scope of the appended claims.

What is claimed is:

1. A system for controlling fuel metering for an internal combustion engine, comprising:

air/fuel ratio detecting means for detecting an air/fuel ratio (KACT) of an exhaust gas of the engine;

engine operating condition detecting means for detecting an operating condition of the engine;

fuel injection quantity determining means for determining a quantity of fuel injection (Tim) to be supplied to the engine;

feedback correction coefficient calculation means for calculating a feedback correction coefficient (KSTR) using an adaptive controller;

feedback control region discriminating means for discriminating as to whether or not the detected engine operating condition is in a feedback control region where a feedback control is to be carried out; and feedback control means for correcting a manipulated variable by the feedback correction coefficient (KSTR) to bring at least one of the detected air/fuel ratio (KACT) and the quantity of fuel injection (Ti) to a desired value (KCMD) in the feedback control region;

wherein the improvement comprising:

said feedback correction coefficient calculation means holding a value necessary for calculating the feedback correction coefficient (KSTR), when leaving the feedback control region.

2. A system according to claim 1, wherein said feedback correction coefficient calculation means holds at least one of variables necessary for calculating the feedback correction coefficient.

3. A system according to claim 2, wherein the adaptive controller receives controller parameters that are estimated/identified by an adaptation mechanism, and said feedback correction coefficient calculation means holds the controller parameters.

4. A system according to claim 2, wherein said adaptive controller has an algorithm expressed in a recursion formula, and said feedback correction coefficient calculation means holds an output of the adaptive controller.

5. A system according to claim 3, wherein said adaptive controller has an algorithm expressed in a recursion formula, and said feedback correction coefficient calculation means holds an output of the adaptive controller.

6. A system according to claim 2, wherein said feedback correction coefficient calculation means holds the detected air/fuel ratio (KACT).

7. A system according to claim 3, wherein said feedback correction coefficient calculation means holds the detected air/fuel ratio (KACT).

8. A system according to claim 4, wherein said feedback correction coefficient calculation means holds the detected air/fuel ratio (KACT).

9. A system according to claim 2, wherein the adaptive controller receives controller parameters that are estimated/identified by an adaptation mechanism, and said feedback correction coefficient calculation means holds a gain matrix which determines estimation/identification speed of the adaptation mechanism.

10. A system according to claim 3, wherein the adaptive controller receives controller parameters that are estimated/ identified by an adaptation mechanism, and said feedback correction coefficient calculation means holds a gain matrix which determines estimation/identification speed of the adaptation mechanism.

11. A system according to claim 4, wherein the adaptive controller receives controller parameters that are estimated/identified by an adaptation mechanism, and said feedback correction coefficient calculation means holds a gain matrix which determines estimation/identification speed of the adaptation mechanism.

12. A system according to claim 5, wherein the adaptive controller receives controller parameters that are estimated/identified by an adaptation mechanism, and said feedback correction coefficient calculation means holds a gain matrix which determines estimation/identification speed of the adaptation mechanism.

13. A system according to claim 6, wherein the adaptive controller receives controller parameters that are estimated/identified by an adaptation mechanism, and said feedback correction coefficient calculation means holds a gain matrix which determines estimation/identification speed of the adaptation mechanism.

14. A system according to claim 2, wherein the held value or values includes a past value or past values thereof.

15. A system according to claim 3, wherein the held value or values includes a past value or past values thereof.

16. A system according to claim 4, wherein the held value or values includes a past value or past values thereof.

17. A system according to claim 6, wherein the held value or values includes a past value or past values thereof.

18. A system according to claim 9, wherein the held value or values includes a past value or past values thereof.

19. A system according to claim 2, wherein said feedback correction coefficient calculation means includes;

time lapse measuring means for measuring a time lapse since leaving the feedback control region;

and when the measured time lapse is larger than a prescribed time, said feedback correction coefficient calculation means sets the held value or values to a prescribed value or prescribed values.

20. A system according to claim 19, wherein the prescribed value or prescribed values are an initial value or values thereof.

21. A system according to claim 3, wherein said feedback correction coefficient calculation means includes;

time lapse measuring means for measuring a time lapse since leaving the feedback control region;

and when the measured time lapse is larger than a prescribed time, said feedback correction coefficient calculation means sets the held value or values to a prescribed value or prescribed values.

22. A system according to claim 21, wherein the prescribed value or prescribed values are an initial value or values thereof.

23. A system according to claim 4, wherein said feedback correction coefficient calculation means includes;

time lapse measuring means for measuring a time lapse since leaving the feedback control region;

and when the measured time lapse is larger than a prescribed time, said feedback correction coefficient calculation means sets the held value or values to a prescribed value or prescribed values.

24. A system according to claim 23, wherein the prescribed value or prescribed values are an initial value or values thereof.

25. A system according to claim 6, wherein said feedback correction coefficient calculation means includes;

time lapse measuring means for measuring a time lapse since leaving the feedback control region;

and when the measured time lapse is larger than a prescribed time, said feedback correction coefficient calculation means sets the held value or values to a prescribed value or prescribed values.

26. A system according to claim 25, wherein the prescribed value or prescribed values are an initial value or values thereof.

27. A system according to claim 9, wherein said feedback correction coefficient calculation means includes;

time lapse measuring means for measuring a time lapse since leaving the feedback control region;

and when the measured time lapse is larger than a prescribed time, said feedback correction coefficient calculation means sets the held value or values to a prescribed value or prescribed values.

28. A system according to claim 27, wherein the prescribed value or prescribed values are an initial value or values thereof.

29. A system according to claim 1, wherein said feedback control means corrects the manipulated variable by multiplying the manipulated variable by the feedback correction coefficient (KSTR).

* * * * *